US005570917A

United States Patent [19]

Cutrer

[11] Patent Number: 5,570,917

[45] Date of Patent: Nov. 5, 1996

[54] HOME SECURITY INTERLOCKING HINGES AND STRIKER PLATES

[76] Inventor: Robert E. Cutrer, P.O. Box 295, Watson, La. 70786

[21] Appl. No.: 402,865

[22] Filed: Mar. 13, 1995

[51] Int. Cl.[6] ..... E05B 17/00; E05D 5/02

[52] U.S. Cl. ..... 292/346; 16/392; 292/DIG. 9

[58] Field of Search ..... 16/DIG. 2, 387, 16/389, 392; 292/146, 340, 346

[56] References Cited

U.S. PATENT DOCUMENTS

| | | | |
|---|---|---|---|
| 1,429,527 | 9/1922 | Paul | 16/389 |
| 2,624,067 | 1/1953 | Tassell | 16/389 |
| 3,811,150 | 5/1974 | Chalmers | 16/352 |
| 4,186,954 | 2/1980 | Detlefs | 282/340 |
| 4,416,087 | 11/1983 | Ghatak | 292/346 |
| 4,809,400 | 3/1989 | Allen | 292/340 |
| 5,024,475 | 6/1991 | Francis | 292/346 |

FOREIGN PATENT DOCUMENTS

| | | | |
|---|---|---|---|
| 2041068 | 9/1980 | United Kingdom | 16/392 |

*Primary Examiner*—Donald M. Gurley

[57] ABSTRACT

This security system will prevent the door casing from failing upon a forced entry attempt into a home by forming a rigid connection from the door casing with said security system to the wall interior structure. It will enable the wall interior structure to become the strength of the door and not the door casing.

6 Claims, 3 Drawing Sheets

HOME SECURITY INTERLOCKING HINGES AND STRIKER PLATES

BACKGROUND OF THE INVENTION

The present invention relates to door hinges and latch striker plate assemblies. It has been developed primarily for use on home entrance doors but is applicable to any door intended for higher security to prevent intruders from a forced entry into the home.

DESCRIPTION OF THE PRIOR ART

There are no prior inventions to my knowledge that resemble the present invention. Though there may be other inventions that have made the attempt to solve the problem of forced entry into the home, I have failed to find any prior invention which focuses on the weakest point of the door assembly, the door casing being the weakest point of the door assembly. Though any prior art should attempt to strengthen one side of the door assembly, all the weak points of the door assembly cannot be ignored. For the door is secured into place on the latched side and also on the hinged side with the total reliance upon the door casing to be the strength of the assembly. In conclusion, the door casing is inadequate to perform the task it was intended to perform, and this is the problem the present invention was designed to correct.

SUMMARY OF THE INVENTION

It is an object of the present invention to overcome the above-mentioned short-coming of the prior art by focusing on the weakest points in the door assembly.

In accordance with the present invention the "Interlocking Latch and Dead Bolt Striker Plates" have connected rod members that are extended through the door casing into the wall interior structure. With a "Reinforcement Plate" that strengthens the door casing and wall interior structure area, to enable the wall interior structure to become the strength of the latched side of the door and not the casing.

Also in accordance with the present invention the "Interlocking Hinges" has connected bracket members on the casing side of the hinge that are extended through the door casing for providing a rigid connection of the hinge to the wall interior structure, to enable the wall interior structure to become the strength of the hinged side of the door and not the casing. There are also connected bracket members on the door side of the hinge to provide a backstop for the door.

Figure 1:
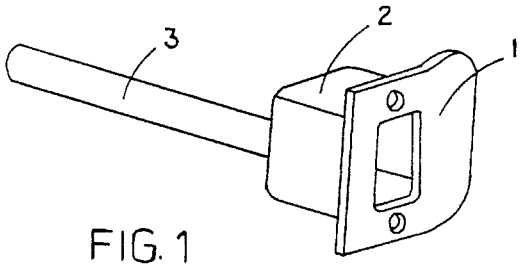
FIG. 1 is a cross-sectional view of the "Interlocking Latch Bolt Striker Plate" for a conventional entrance door knob.

The numerals below have an explanation of what they represent in the drawings:

1. Door Latch Striker Plate

2. Latch Bolt Housing

3. "Connected Rod Member" to latch bolt housing

4. Dead Bolt Striker Plate

5. Dead Bolt Housing

6. "Connected Rod Member" to dead bolt housing

7. "Casing Reinforcement Part" of the Reinforcement Plate

8. "Casing Stop Part" of the Reinforcement Plate

9. "Anchoring Part" of the Reinforcement Plate

10. Casing Side of the Hinge

11. "Connected Bracket Member" of the casing side of the hinge to provide a rigid connection of the hinge to the wall interior structure.

12. Door Side of the Hinge

13. Door Backstop Plate

14. Hinge Side of the Door

14'. Latch Side of the Door

15. Hinge Side of the Door Casing

15'. Latch Side of the Door Casing

15A. Hinge Side of the Door Casing, where the casing is slotted to allow the "Connected Bracket Member" (#11) to extend through the door casing.

16. "Wall Interior Structure" on the hinge aide of the door.

16'."Wall Interior Structure" on the latch side of the door. NOTE: "Hinges" and "Striker Plates" are constructed of ⅛" thick metal.

DETAIL DESCRIPTION OF DRAWINGS

Figure 2:
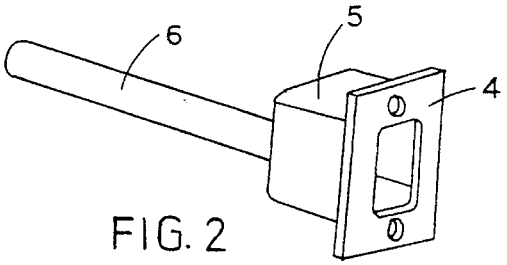
FIG. 2 is a cross-sectional view of the "Interlocking Dead Bolt Striker Plate" for a conventional entrance door dead bolt.

Referring to the drawings wherein like numerals represent like parts throughout the description of the installation and function of the different components of FIG. 1, 2, 3, & 4. Thus FIG. 5 can be used for a top view and FIG. 6 can be used for a front view to provide a clear picture and understanding of what each component will accomplish when installed. Remember in FIG. 5 the "Dead Bolt Striker Plate" assembly FIG. 2 is not shown.

Figure 3:
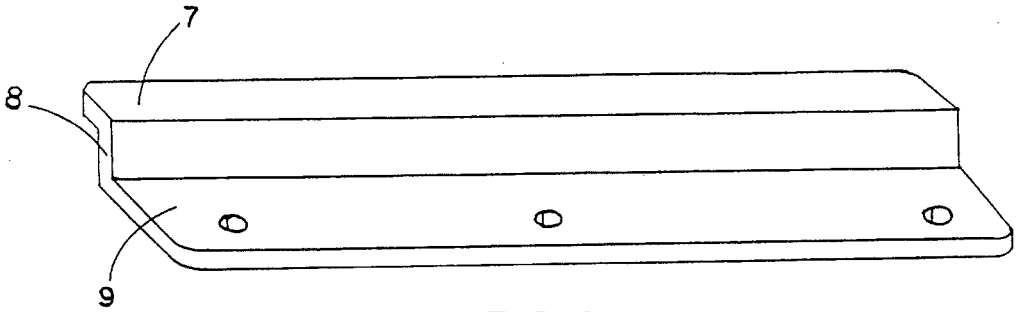
FIG. 3 is a cross-sectional view of the "Reinforcement Plate".
Figure 5:
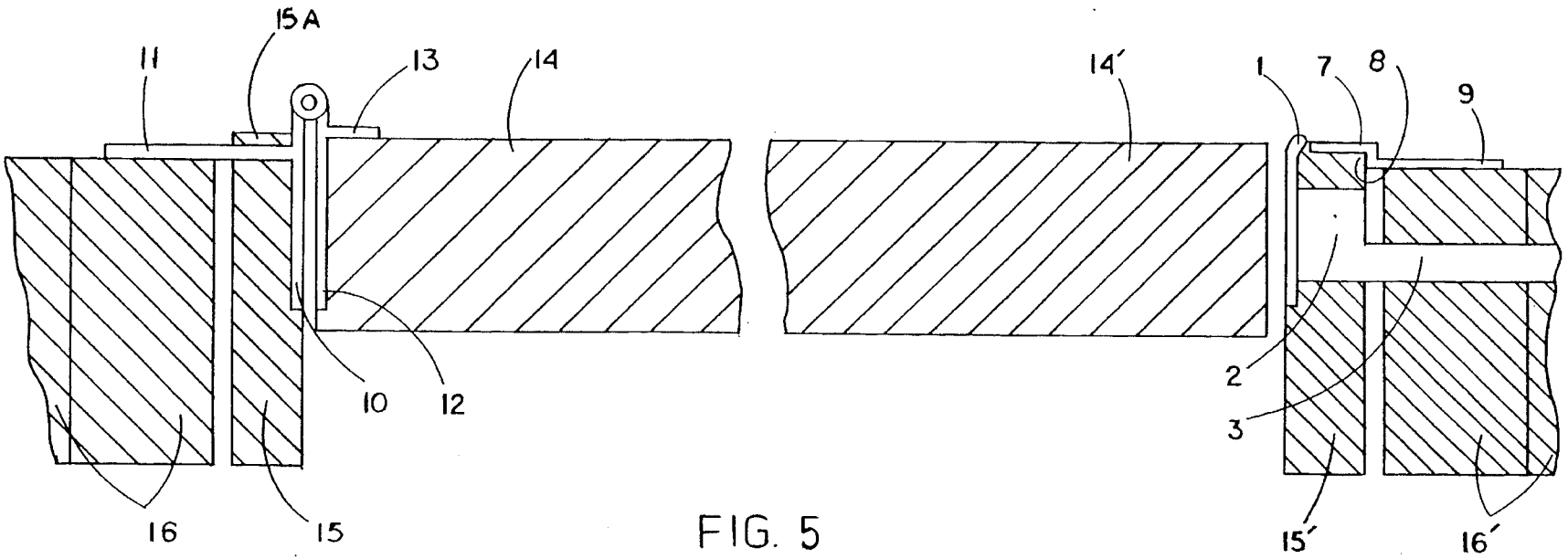
FIG. 5 is a top view of the bracket members shown in an assembled condition. It is impossible to differentiate between FIG. 1 and FIG. 2 from this position.
Figure 6:
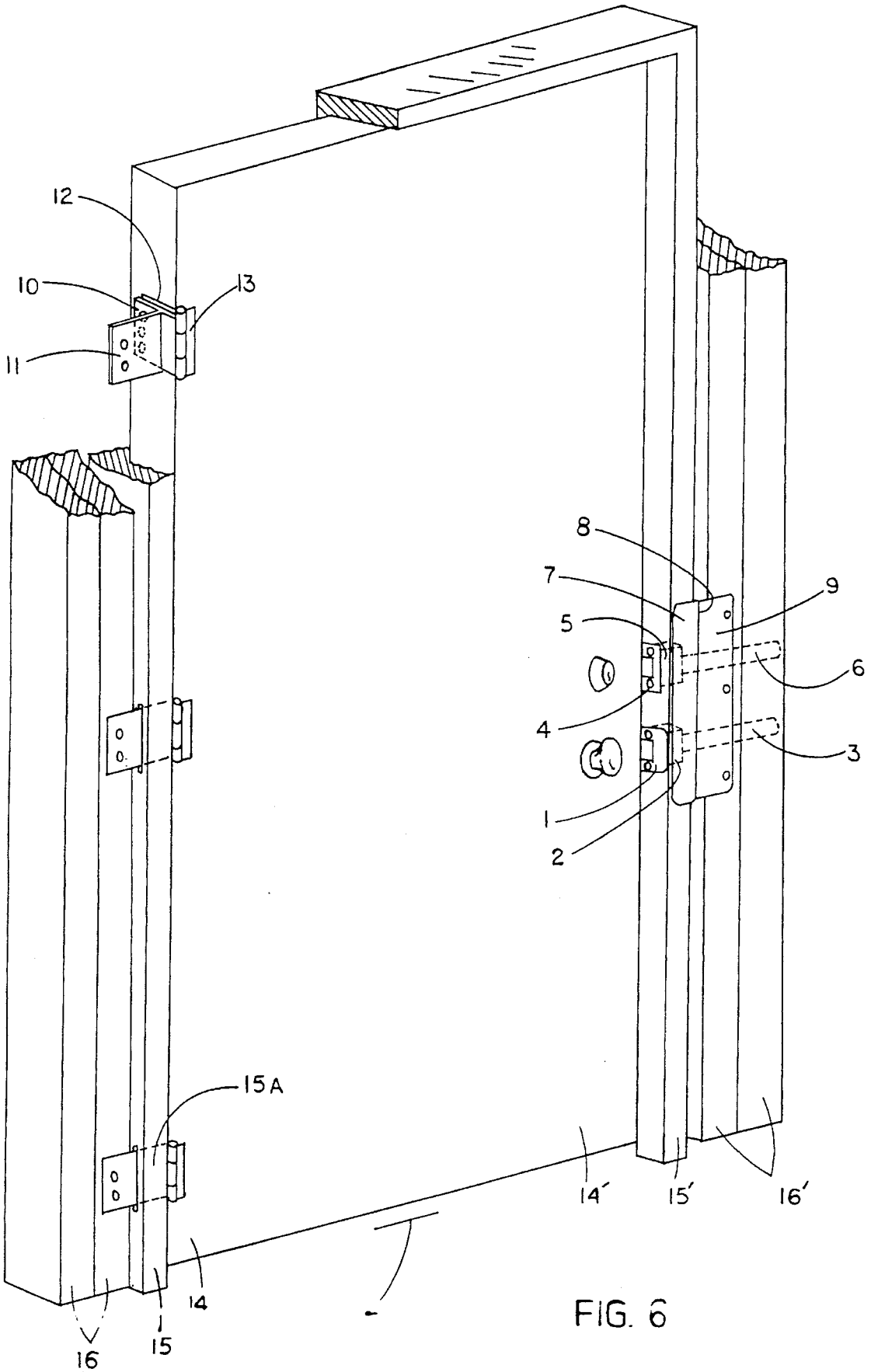
FIG. 6 is a front view of the bracket members shown in an assembled condition.

Referring to FIG. 1 and FIG. 2, their installation and function are comparably the same. The door latch striker plate 1 and the dead bolt striker plate 4 are recessed into the door casing 15'. The latch and dead bolt housing 2 & 5 go into the door casing 15', the latch and dead bolt housing 2 & 5 are not to extend past the door casing 15', as seen in FIG. 5 as a precaution to prevent any complications with the installation of the Reinforcement Plate FIG. 3. Extending from the latch and dead bolt housings 2 & 5 are the solid ½" O.D. connected rod members 3 & 6, that extends into the wall interior structure 16' to enable the wall interior structure 16' to become the strength of the latched side of the door 14' and not the door casing 15'. FIG. 1 and FIG. 2 are secured into place with 4" screws, so they will extend past the door casing 15' and will screw into the wall interior structure 16'. NOTE: FIG. 3 must be secured into place before FIG. 1 & 2. The reason for this sequence will be explained in reference to FIG. 3.

Referring to FIG. 3, it has three different functions it will accomplish. Without FIG. 3, FIG. 1 & 2 could not be installed as you will see in the description of FIG. 3. It is the combination of FIG. 1, 2, & 3 together that accomplishes the task of fortifying the door casing 15'. It was previously mentioned that FIG. 3 must be installed before FIG. 1 & 2. Thus, the door casing 15' will be recessed for the casing reinforcement part of the plate 7. This part of the plate provides extra strength to the casing area 15'. The casing reinforcement part of the plate 7 is recessed into the door casing 15' to enable the door trim molding to be installed as normal. NOTE: The door trim molding is not shown in the drawings.

The casing stop part of the plate 8 is the reason FIG. 3 must be installed before FIG. 1 & 2. The casing stop part of the plate 8 is placed securely against the door casing 15'. At this point FIG. 3 can be anchored into the wall interior structure 16'. Thus, once FIG. 3 is anchored into place FIG. 1 & 2 can be installed. Without the casing stop part of the plate 8, the 4" screws used to install FIG. 1 & 2 would pull the door casing 15' toward the wall interior structure 16' causing the door casing 15' to be pulled out of alignment.

The anchoring part of the plate 9 is anchored to the wall interior structure 16' with 2" screws, thus, the anchoring part of the plate 9 is to strenghten the wall interior structure 16', the area where the rods 3 & 6 are located. Once FIG. 3 is installed a door trim molding will conceal it, for it is designed so that the anchoring part of the plate 9 is not to extend past the designated area for the trim molding. Thus with the combination of FIG. 1, 2, and 3 together the door casing 15' is made strong enough to withstand the pressure that would normally cause the door casing 15' to fail, which I have consistently proven with a prototype.

Figure 4:
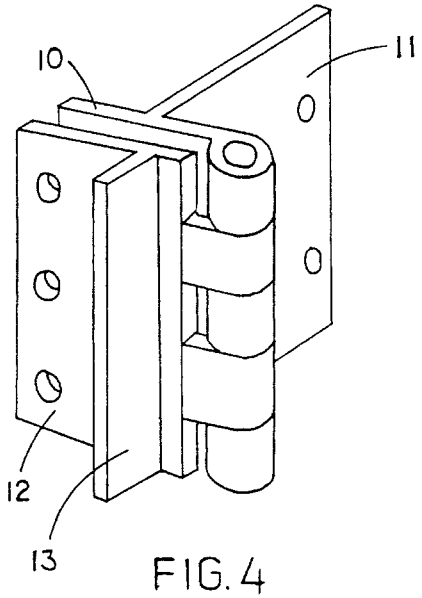
FIG. 4 is a elevated side view of the "Interlocking Hinges".

Referring to FIG. 4 it is designed to interlock into the wall interior structure 16 by slotting the door casing 15, to allow the connected bracket member 11 of the casing side of the hinge 10 to extend through the door casing 15 and fit securely on top of the wall interior structure 16. Before the connected bracket member 11 is anchored into place it is necessary for the casing side of the hinge 10 to be properly recessed into the door casing 15. Once the casing side of the hinge 10 is fitting properly, the connected bracket member 11 can be anchored into place with 2" screws into the wall interior structure 16. NOTE: The connected bracket member 11 must be anchored into place prior to installing the 4" screws for the casing side of the hinge 10 to prevent the door casing 15 from being pulled in toward the wall interior structure 16, causing the door casing 15 to be pulled out of alignment. Thus, once the connected bracket member 11 is anchored into place, the casing side of the hinge 10 can be secured into place with the 4" screws so they will extend past the door casing 15 and will screw into the wall interior structure 16. The connected bracket member 11 will be concealed with a door trim molding, for it is installed so that the door casing 15 is slotted to allow the connected bracket member 11 to be covered with the door casing 15A, and the connected bracket member 11 is designed not to extend past the designated area for the trim molding, so that once the door trim molding is installed it will have its standard normal appearance.

The door side of the hinge 12 is still secured to the door 14 in the normal conventional manner, but with the casing side of the hinge 10 being interlocked with the wall interior structure 16. When force is applied instead of the screws being pulled out of the casing 15, it would now cause the force to strip or pull the screws out of the door 14. Thus, this is the reason for the door backstop plate 13, a connected bracket to the door side of the hinge 12, to prevent the door 14 from being able to be forced back when pressure is applied and eliminate the reliance upon the screws to withstand any force. Thus with the combination of the connected bracket member 11 to provide a rigid connection of the hinge 10 to the wall interior structure 16, also with the door backstop plate 13 to prevent the door from being forced back this combination together makes the door casing 15 strong enough to withstand the pressure that would normally cause the door casing 15 to fail. I have successfully proven this theory with a prototype.

This security system will fortify the door assembly by overcoming the weak points of the door assembly by the wall interior structure becoming the strength of the door assembly and not the door casing. Thus the following subject matter comprises my invention.

I claim:

1. In a door assembly comprising a door having a narrow side, a substantially rigid interior wall structure, and a door casing, wherein said door casing is attached to said interior wall structure, a security hinge assembly for said door, comprising:

a first bracket, including:

(a) a door attachment plate secured to said narrow side of said door;

(b) a backstop plate extending from said door attachment plate; and (c) first hinging means extending from said door attachment plate for making a hinged connection with a second hinging means; and a second bracket, including:

(a) a door casing attachment plate secured to said door casing;

(b) a wall structure attachment plate, secured to said interior wall structure, extending from said door casing attachment plate; and (c) second hinging means extending from said door casing attachment plate for making a hinged connection with said first hinging means;

wherein said second hinging means of said second bracket are hingedly connected to said first hinging means of said first bracket.

2. The security hinge assembly of claim 1, wherein said backstop plate extends substantially perpendicular from door attachment plate.

3. The security hinge assembly of claim 1, wherein said wall structure attachment plate extends substantially perpendicular from said door casing attachment plate.

4. In a door assembly comprising a door having a narrow side, a substantially rigid interior wall structure, and a door casing, wherein said door casing is attached to said interior wall structure, a security hinge and striker plate system for said door, comprising:

(a) at least two security hinge assemblies connected between said door, said door casing and said interior wall structure, wherein each said security hinge assembly comprises:

(i) a first bracket, including:

(a) a door attachment plate secured to said narrow side of said door;

(b) a backstop plate extending from said door attachment plate; and (c) first hinging means extending from said door attachment plate for making a hinged connection with a second hinging means; and (ii) a second bracket, including:

(a) a door casing attachment plate secured to said door casing;

(b) a wall structure attachment plate, attached to said interior wall structure, extending from said door casing attachment plate;

(c) second hinging means extending from said door casing attachment plate for making a hinged connection with said fast hinging means;

wherein said second hinging means of said second bracket are hingedly connected to said first hinging means of said first bracket;

(b) a security striker plate assembly attachable to said door casing and said interior wall structure, comprising:

(i) a striker plate attached to said door casing and said interior wall structure, wherein said striker plate includes an opening adapted to receive a slidable member from said door;

(ii) a housing attached to said striker plate for insertion into a recess in said door casing; and (iii) a rod member, attached to said housing and extending substantially perpendicular to said striker plate, for insertion into said interior wall structure; and (c) a reinforcement assembly attached to said interior wall structure, comprising:

(i) an anchor plate attached to said interior wall structure in a first plane;

(ii) a stop plate extending perpendicularly from said anchor plate which abuts said door casing for preventing movement of said door casing toward said interior wall structure; and (iii) a reinforcement plate extending from said stop plate in a second plane offset and parallel to said first plane of said anchor plate for contacting said door casing adjacent to said striker plate and preventing movement of said door casing away from said interior wall structure.

5. The security hinge and striker plate system of claim 4, wherein said backstop plate extends substantially perpendicular from door attachment plate.

6. The security hinge and striker plate system of claim 4, wherein said wall structure attachment plate extends substantially perpendicular from said door casing attachment plate.

* * * * *